US006795023B2

(12) United States Patent
Chen

(10) Patent No.: US 6,795,023 B2
(45) Date of Patent: Sep. 21, 2004

(54) BROADBAND SUSPENDED PLATE ANTENNA WITH MULTI-POINT FEED

(75) Inventor: Zhi Ning Chen, Singapore (SG)

(73) Assignee: The National University of Singapore, Singapore (SG)

( * ) Notice: Subject to any disclaimer, the term of this patent is extended or adjusted under 35 U.S.C. 154(b) by 62 days.

(21) Appl. No.: 10/142,999

(22) Filed: May 13, 2002

(65) Prior Publication Data

US 2003/0210192 A1 Nov. 13, 2003

(51) Int. Cl.[7] ..... H01Q 1/38
(52) U.S. Cl. ..... 343/700 MS; 343/702; 343/850
(58) Field of Search ..... 343/700 MS, 702, 343/829, 830, 846, 848, 850

(56) References Cited

U.S. PATENT DOCUMENTS

| | | | | |
|---|---|---|---|---|
| 4,605,933 A | | 8/1986 | Butscher | 343/700 MS |
| 4,835,540 A | * | 5/1989 | Haruyama et al. | 343/700 MS |
| 5,801,660 A | * | 9/1998 | Ohtsuka et al. | 343/700 MS |
| 6,072,434 A | * | 6/2000 | Papatheodorou | 343/700 MS |

OTHER PUBLICATIONS

T. Huynh and K.F. Lee "Single–Layer Single–Patch Wideband Microstrip Antenna", Electronics Letters, vol. 31, No. 16, pp. 1310–1312, Aug. 3, 1995.

K.M. Luk et al. "Broadband Microstrip Patch Antenna", Electronic Letters, vol. 34, No. 15, pp. 1442–1443, Jul. 23, 1998.

Z.N. Chen and M.Y.W. Chia "Design of Broadband Probe–Fed Plate Antenna With Stub", IEE Proc. Microw. Antennas Prograg., vol. 148, No. 4, pp. 221–226, Aug. 2001.

Z.N. Chen and M.Y.W. Chia "Broadband Suspended Plate Antenna With Probe–Fed Strip", IEE Proc. Microw. Antennas Prograg., vol. 148, No. 1, pp. 37–40, Feb. 2001.

P.S. Hall "Probe Compensation in Thick Microstrip Patches", Electronic Letters, vol. 23, No. 11, pp. 606–607, May 1987.

* cited by examiner

*Primary Examiner*—Shih-Chao Chen
(74) *Attorney, Agent, or Firm*—Nath & Associates PLLC; Harold L. Novick; Marvin C. Berkowitz

(57) ABSTRACT

Feeding structures for suspended plate antennas are disclosed hereinafter for enhancing the impedance bandwidth performance thereof. In any of these feeding structures, a multi-dimensional broadband impedance transformer is integrated with a suspended plate antenna. The impedance transformer electrically connects the radiating plate and feeding probe of the suspended plate antenna. As a result, the impedance bandwidth is increased. Moreover, the multi-dimensional design of the impedance transformer is variable to allow the flexible design and adjustment of the feeding structure.

20 Claims, 6 Drawing Sheets

BROADBAND SUSPENDED PLATE ANTENNA WITH MULTI-POINT FEED

FIELD OF INVENTION

The invention relates generally to antennas. In particular, the invention relates to a broadband suspended plate antenna

BACKGROUND

Rapidly developing modern wireless communication systems require antennas of small size, low cost, powerful performance, and ease of manufacture and integration. Miniature or compact antennas are suited for achieving mobility of communication units and sectorization of base station antennas. Ease of manufacture and cheap materials lower the cost of antennas in industrial applications. To meet the performance standards required by modem wireless communication systems, broadening the bandwidths of antennas is becoming increasingly necessary and challenging.

Conventional planar antennas in their basic forms, such as microstrip patch antennas, planar inverted L- or F-antennas (ILAs or IFAs), and suspended plate antennas, suffer an inherently narrow impedance bandwidth, typically of only a few percent. The narrow impedance bandwidth of conventional planar antennas limits the broadband applications of conventional planar antennas.

To alleviate the problem of narrow impedance bandwidth, some techniques have been proposed for the design of broadband planar antennas.

For microstrip patch antennas, techniques such as the addition of parasitic elements, the use of electrically thick substrates, and the introduction of matching networks have been widely used. The enhanced impedance bandwidth for a single-layer single-element design is usually less than 10% for a voltage standing wave ratio (VSWR) of 2:1.

For planar ILAs or IFAs, techniques such as replacing the wire radiators of the wire ILAs or IFAs with planar radiators and/or loading material with high permittivity are usually employed. The improved impedance bandwidth is also approximately 10% for a VSWR of 2:1.

For suspended plate antennas with thick substrates of low dielectric constants, slotting or notching the plates as well as electromagnetic coupling between the plates and probes of the suspended plate antennas have been introduced to realise good matching conditions in broadband applications. Ameliorated impedance bandwidths are in the order of 10%~40% for a VSWR of 2:1.

However, each of the proposed techniques for alleviating the narrow impedance bandwidth problem has drawbacks.

For microstrip patch antennas, adding the parasitic elements vertically or laterally increases size, cost and complexity of manufacture. Using the electrically thick substrates increases cost and lowers radiation efficiency due to increased surface waves and dielectric loss. Introducing matching networks reduces radiation efficiency and complicates the design and fabrication of the antenna. For a single-layer single-element design, the achievable impedance bandwidth is limited, usually less than 10% for a VSWR of 2:1.

Planar ILAs or IFAs loaded with material of high permittivity suffer from large size and high cost. The achievable impedance bandwidth is approximately 10% for a VSWR of 2:1.

Suspended plate antennas have broadened impedance bandwidths in the order of 10% ~40% for a VSWR of 2:1 after application of various impedance-matching techniques.

In U.S. Pat. No. 4,605,933, an impedance tab is introduced to increase the impedance bandwidth of a suspended microstrip antenna, in which part of the ground plane near the feed of the suspended microstrip antenna is raised and made parallel to the antenna's radiator. The impedance bandwidth is increased to 70% for a VSWR of 2:1. However, the complexity of manufacture as well as the difficulty of array applications also increases as a result.

There is clearly a need for feeding structures for increasing the impedance bandwidth of suspended plate antenna.

SUMMARY

Feeding structures for suspended plate antennas are disclosed hereinafter for enhancing the impedance bandwidth performance of such antennas. When applying any of these feeding structures, a multi-dimensional broadband impedance transformer is integrated with a suspended plate antenna. The impedance transformer electrically interconnects the radiating plate and feeding probe of the suspended plate antenna. As a result, the impedance bandwidth is increased. The multi-dimensional design of the impedance transformer is variable to allow the flexible design and adjustment of the feeding structure.

Through the multi-dimensional broadband impedance transformer, the radiating plate is fed at multiple points such as a line or an area. This feeding technique provides for the simultaneous excitement of the radiating plate in different positions even though the feeding probe is a conventional narrow or thin feeding probe.

The radiating plate may be any or combination of rectangular, circular, triangular, bow-tie-like, trapezoidal and the like geometric shape. The radiating plate may also include any or combination of vertical and lateral parasitic elements. The radiating plate may also be flat or uneven. The radiating plate may also be notched or slotted. The radiating plate may also be short-circuited by one or more pins or sheets to the ground plane of the suspended plate antenna.

The impedance transformer may be electrically connected to the probe or other signal feeding means for the radiating plate. The impedance transformer may also be notched or slotted. The impedance transformer may also be any or combination of one or more flat sheets, one or more cylinders or part thereof, and one or more symmetric or asymmetric bodies with contours of arbitrary shapes and profiles.

The ground plane may be any or combination of rectangular, circular, triangular, bow-tie-like, trapezoidal and the like geometric shape. The ground plane may also be flat or uneven. The ground plane may also be infinite or finite. The ground plane may also be notched or slotted.

The technique of simultaneously feeding the radiating plate at multiple points such as a line or an area at the different positions of the radiating plate may be applied to antenna arrays with two or more antenna elements. The feeding technique may also be used in linear polarization or circular polarization applications. The feeding scheme may also be used in broadband and multi-band, or multi-mode applications.

Therefore in accordance with a first aspect of the invention, there is disclosed hereinafter a broadband suspended plate antenna. Such an antenna comprises means for feeding signals to the antenna, a ground conductor, and a radiating element which is separated from the ground conductor. The antenna also comprises a feeding element which is electrically connected to the radiating element through a plurality of feed points on the radiating element, wherein the feeding element is electrically connected to the means for feeding signals and stacked with the radiating element and ground conductor.

In accordance with a second aspect of the invention, there is disclosed hereinafter a method for feeding a broadband suspended plate antenna having a radiating element and ground conductor. The method comprises the steps of feeding signals to the antenna, separating a radiating element from a ground conductor, and providing a feeding element and electrically connecting the feeding element to the radiating element through a plurality of feed points on the radiating element, wherein the feeding element is electrically connected to the means for feeding signals and stacked with the radiating element and ground conductor.

BRIEF DESCRIPTION OF DRAWINGS

Embodiments of the invention are described hereinafter with reference to the drawings, in which.

DETAILED DESCRIPTION

Embodiments of the invention are described hereinafter for addressing the need for feeding structures for advantageously increasing the impedance bandwidth of suspended plate antennas to the order of 60% or above for a VSWR of 2:1.

The feeding structures according to embodiments of the invention relate to impedance matching structures which are used to further enhance the impedance bandwidth of suspended plate antennas. The feeding structures further relate to suspended plate antenna feeding methods, in which the radiating plates of suspended plate antennas are fed electrical signals by feeding structures which include multi-dimensional impedance transformers. For all intents and purposes herein, the multi-dimensional impedance transformers are constructed with profiles or cross-sections which when taken along planes substantially parallel to the radiating plates are substantially larger than the profiles or cross-sections of conventional narrow or thin signal feeding means such as feeding probes. The resultant impedance bandwidth is improved to a great extent over conventional suspended plate antennas employing such conventional narrow or thin signal feeding means.

Figure 1A:
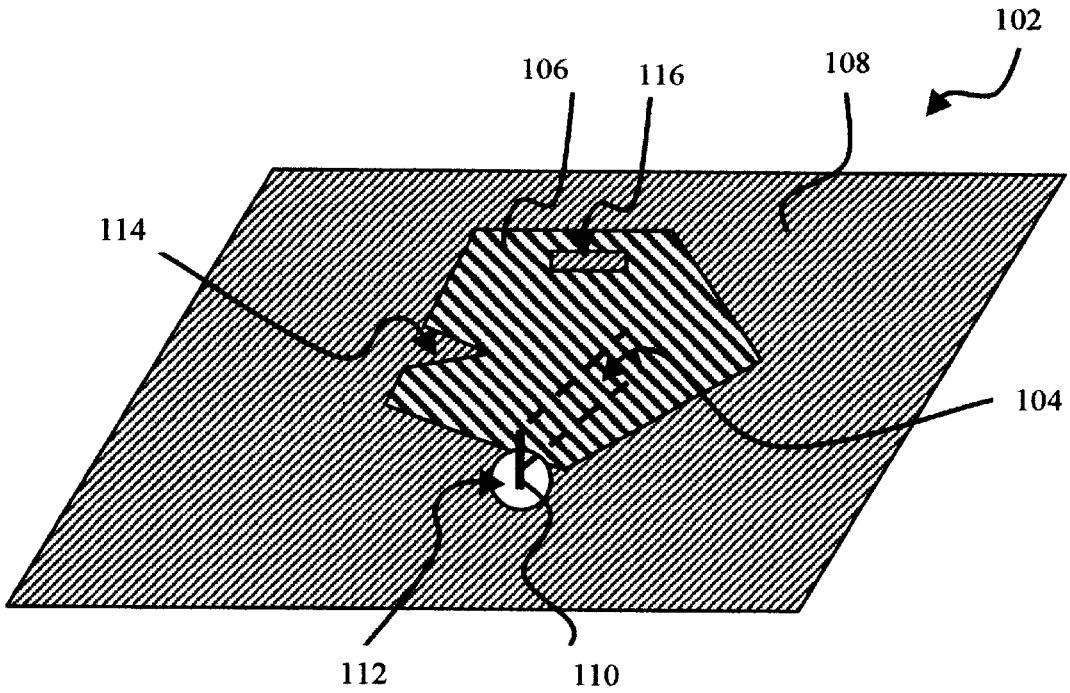
FIG. 1*a* shows a perspective view of a suspended plate antenna with a feeding structure according to an embodiment of the invention.
Figure 1B:
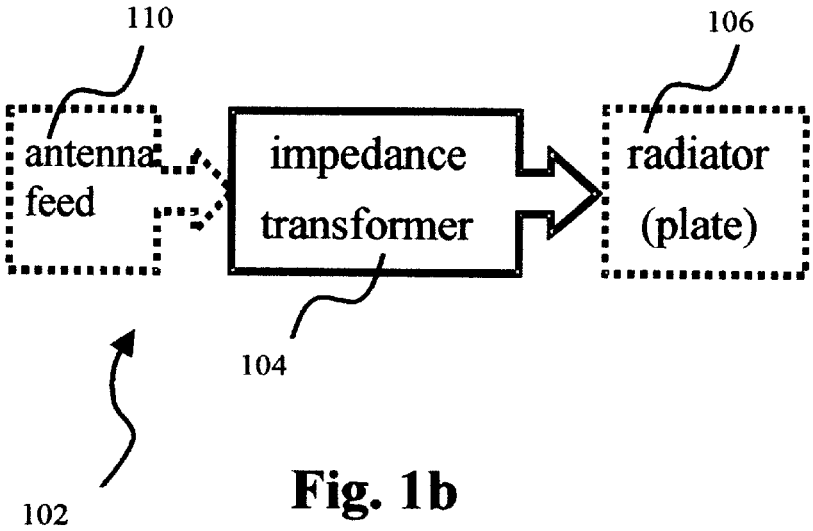
FIG. 1*b* shows a block diagram of the suspended plate antenna of FIG. 1*a;*

The feeding structures for suspended plate antennas are described hereinafter with reference to FIGS. 1*a,* 2*a* and 3 according to various embodiments of the invention for enhancing the impedance performance of the suspended plate antennas. Any of these feeding structures differs from conventional feeding structures such as a coaxial probe or aperture coupling because the feeding structure integrates a feeding element which is multi-dimensional broadband impedance transformer into a suspended plate antenna. The broadband impedance transformer electrically interconnects the radiating element, such as the radiating plate, and signal feeding means, such as the feeding probe, of the suspended plate antenna as shown in FIG. 1*b.* As a result, the impedance bandwidth of the suspended plate antenna is increased. Moreover, the two- or three-dimensional design of the impedance transformer allows the flexible design and adjustment of the feeding structure.

The embodiments of the invention are inherently associated with a number of advantages. In accordance with embodiments of the invention, a feeding structure for increasing the impedance bandwidth of suspended plate antennas includes multi-dimensional impedance transformer. Such an impedance transformer is integrated into the suspended plate antenna without increasing its overall dimensions. The impedance transformer is simple in construction which therefore advantageously renders the design of the feeding structure flexible. In addition, the impedance transformer advantageously facilitates ease of manufacture in relation to the suspended plate antenna.

The attendant feeding method requires the feeding structure to feed the radiating plate at multiple spaced-apart or contiguous points forming a line or an area, continuous or otherwise, instead of a small point. This feeding method is based on feeding the suspended plate antenna via an signal feeding means using a conventional thin feeding probe, such as a coaxial probe of a surface mount adapter (SMA), and electrically connecting through the feeding structure to the radiating plate at multiple points such as a line or an area by means of an impedance transformer. Doing this allows the feeding currents to simultaneously excite the radiating plate at the respective positions of the radiating plate. This feeding method therefore advantageously allows a broader impedance bandwidth to be achieved than the conventional feeding method of using only a narrow or thin feeding probe to directly feed the radiating plate.

By means of such a feeding method, the impedance performance of the suspended plate antennas may be advantageously improved without the use of any parasitic elements.

The structure of a suspended plate antenna 102 with a feeding element herein known as an impedance transformer 104 according to an embodiment of the invention is described in greater detail with reference to FIGS. 1*a* and 1*b.* In the suspended plate antenna 102, a radiating plate 106 used as a radiating element is preferably electrically thin and perfectly conducting and suspended in parallel to a ground conductor such as a ground plane 108. A probe-type feeding structure 110 extending through a feed-through 112 such as an aperture in the ground plane 108 functioning as a signal feeding means is preferably used. The impedance transformer 104, which is preferably a perfectly electrically conduction element and multi-dimensional, electrically interconnects the probe-type feeding structure 110 to the radiating plate 106. The radiating plate 106 and impedance transformer 104 may be completely or partly supported by electrically thin/thick air, foam or any other infinitely/finitely-size dielectric materials.

The radiating plate 106 may also be of rectangular, triangular, trapezoidal, circular, bow-tie-like shapes, or other variations or combinations of such geometrical shapes. The radiating plate may also include a notch 114 or slot 116. The radiating plate may be flat or uneven, a single-layer single-element, or include stacked or parasitic elements which may be vertically or laterally attached to the radiating plate 106.

The multi-dimensional conducting element of the impedance transformer 104 may be one or more sheets of rectangular, triangular, trapezoidal, circular, bow-tie-like shape, or other variations or combinations of such geometric shapes and profiles. The multi-dimensional conducting element of the impedance transformer 104 may also be one or more symmetrical or asymmetrical bodies of revolution of arbitrary contours such as rectangular, triangular, circular shapes, curves, or the like shapes and profiles. The multi-dimensional conductive element may also be notched or slotted and flat or uneven.

Figure 2A:
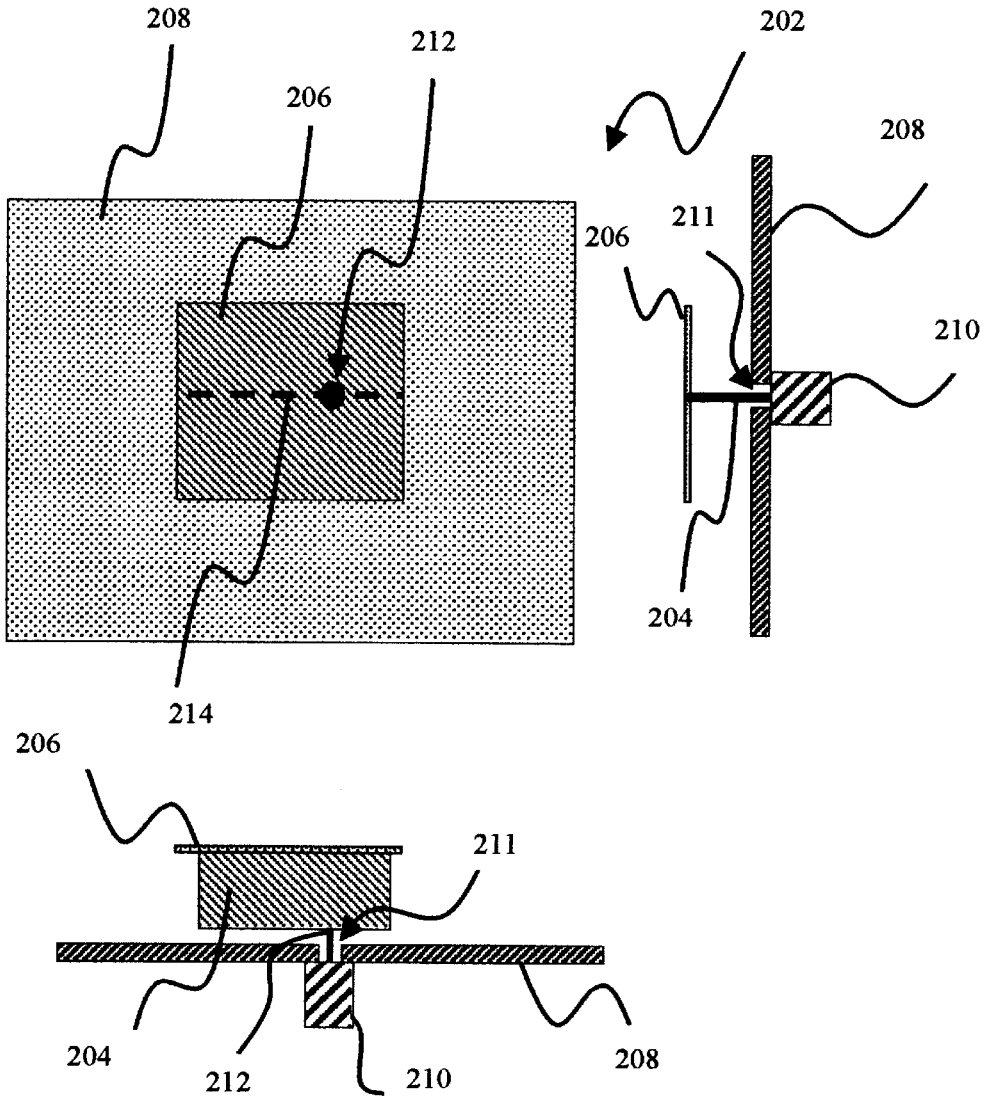
FIG. 2*a* shows views of the front, side and bottom elevations of a rectangular suspended plate antenna with an impedance transformer for linear polarization operations according to a first embodiment of the invention.
Figure 2B:
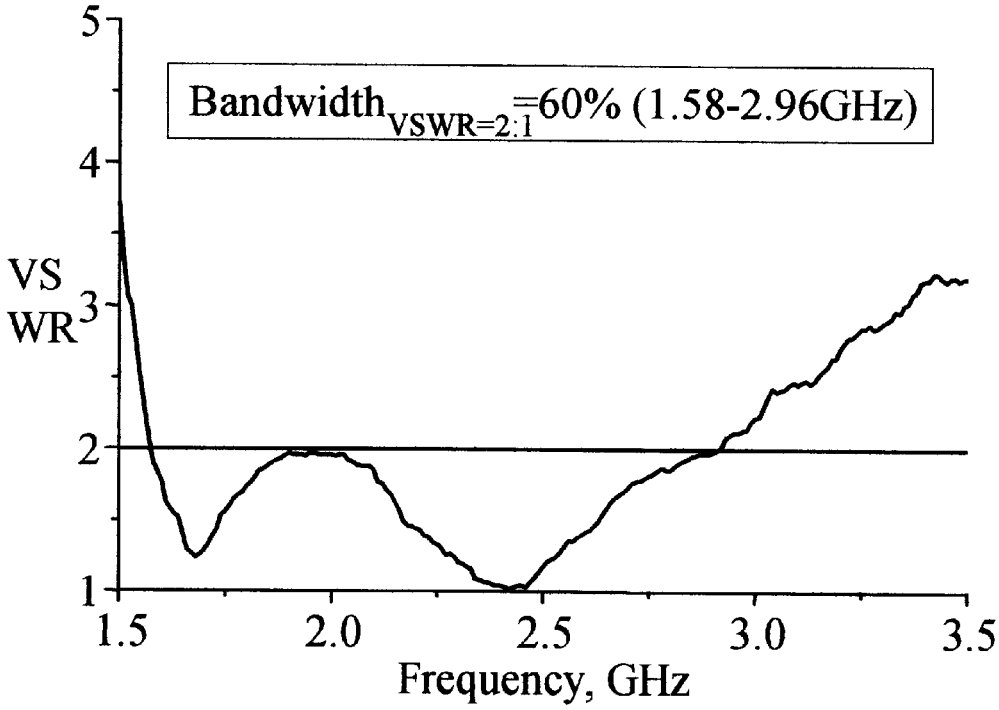
FIG. 2*b* shows the measured VSWR of the rectangular suspended plate antenna shown of FIG. 2*a;*
Figure 2C:
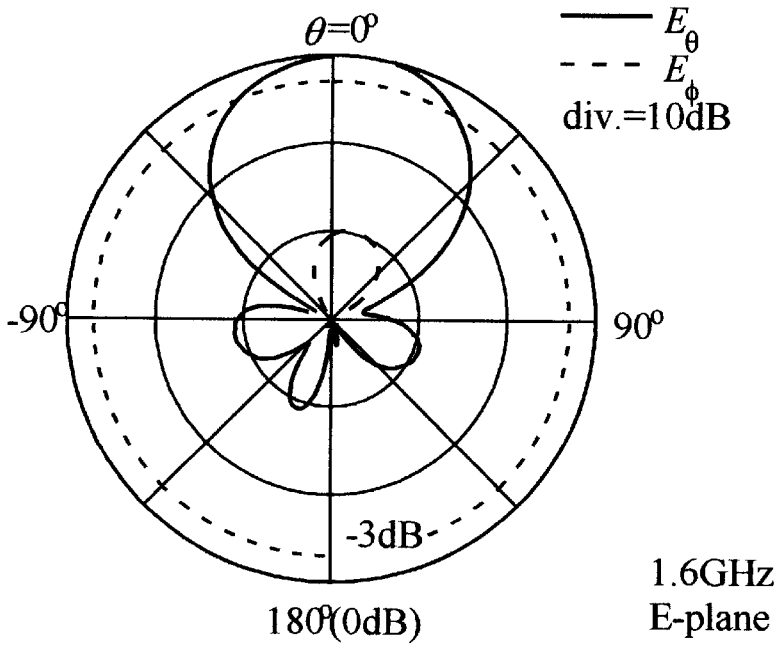
FIG. 2*c* shows the measured radiation patterns (E-plane) of the rectangular suspended plate antenna of FIG. 2*a* at operating frequencies of 1.6 GHz and 2.4 GHz.
Figure 2C:
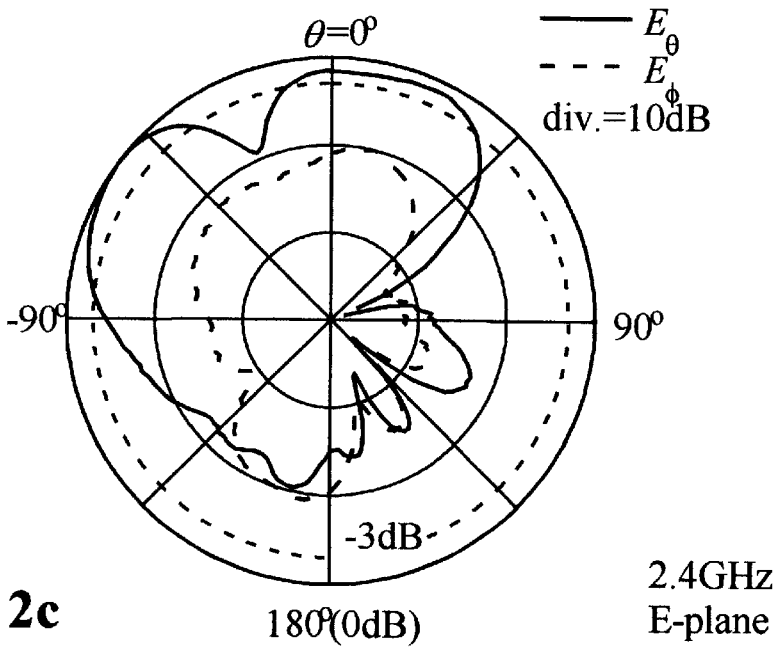
Figure 2D:
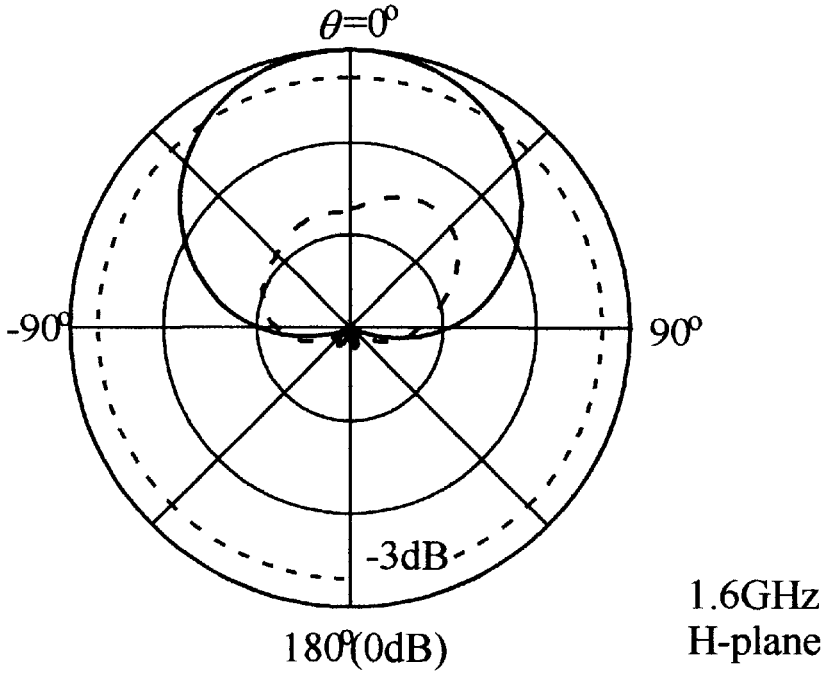
FIG. 2*d* shows the measured radiation patterns (H-plane) of the rectangular suspended plate antenna of FIG. 2*a* at operating frequencies of 1.6 GHz and 2.4 GHz.
Figure 2D:
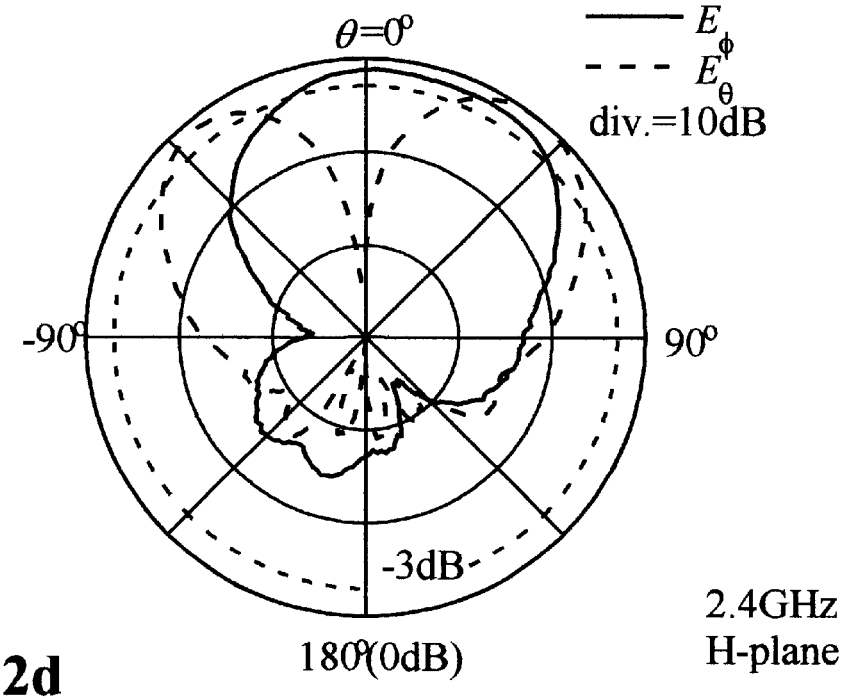

FIG. 2*a* shows a broadband rectangular suspended plate antenna 202 for linear polarization operation in accordance with a first embodiment of the invention. The rectangular suspended plate antenna 202 is preferably a planar structure formed from planar conducting materials and is capable of achieving a low VSWR over a broad frequency range, typically more than 60% for VSWR$\leqq$2:1 as illustrated in FIG. 2*b*. The far-field radiation patterns in the E- and H-planes of the suspended plate antenna 202 are also measured and plotted in FIGS. 2*c* and 2*d*, respectively.

Figure 3:
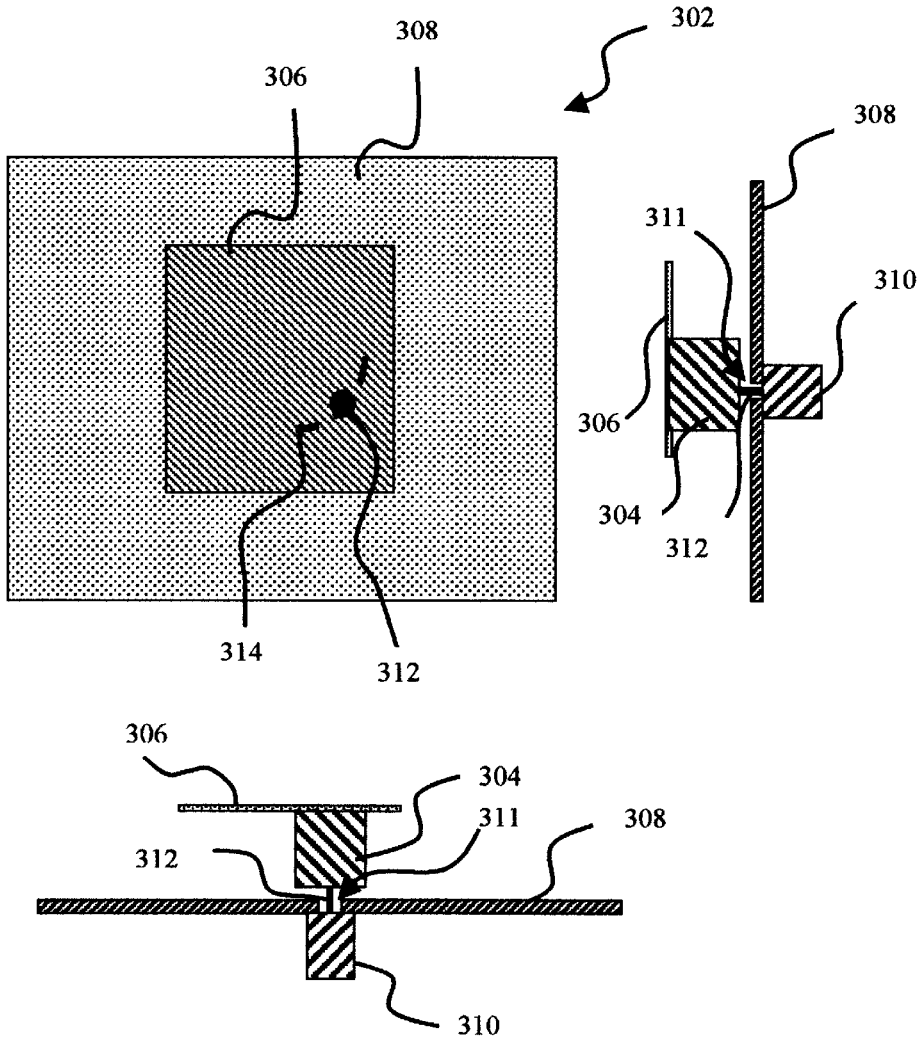
FIG. 3 shows views of the front, side and bottom elevations of a rectangular suspended plate antenna with an impedance transformer for circular polarization operations according to a second embodiment of the invention.

For purposes of brevity, only the structure of the first embodiment shown in FIG. 2*a* is described in detail. The structure of the second embodiment shown in FIG. 3, which is a broadband rectangular suspended plate antenna 302 for circularly polarized operation, in general includes parts or features such as radiating plate, ground plane, and feeding probe, that are have similar geometric shapes and profiles with parts or features in the first embodiment, excepting the shapes of the feeding structure. Such similarly shaped parts or features in the second embodiment are therefore designated by reference numerals that correspond to reference numerals designating the corresponding parts or features of the first embodiment.

In the rectangular suspended plate antenna 202 shown in FIG. 2*a*, a multi-dimensional electrically conducting element, which is preferably perfectly electrically conducting, functioning as an impedance transformer 204 is introduced not only an impedance matching element for the rectangular suspended plate antenna 202 but also as a feeding structure. By implementing the rectangular suspended plate antenna 202 with the impedance transformer 204, which is a preferably conductive planar metal plate, and feeding the rectangular suspended plate antenna 202 through the impedance transformer 204, a broadband suspended plate antenna having a simple mechanical structure is therefore achieved. In the case of the rectangular suspended plate antenna 202, the impedance transformer 204 is electrically connected to radiating element which is a rectangular-shaped radiating plate 206 which is preferably stacked between the radiating plate 206 and a ground conductor which is ground plane 208 in a generally upright manner.

The radiating plate 206 preferably consists of a piece of suitable conductive metal plate. The radiating plate 206 may be attached to any dielectric substrate or superstrate. The ground plane 208 lies in parallel with and is spaced apart from the radiating plate 206. The radiating plate 206 is disposed in relation to the ground plane 208 in a manner so that the orthogonal projection of the radiating plate 206 on the ground plane 208 lies substantially within the borders of the ground plane 208. Preferably, a commercial SMA connector 210 is used for feeding the rectangular suspended plate antenna 202 through a coaxial probe 212 electrically connected to the impedance transformer 204, the coaxial probe 212 extending through an aperture or feed-through 211 in the ground plane 208. The impedance transformer 204 in turn feeds the radiating plate 206 along a substantially straight and continuous feed line 214 thereby allowing the feeding currents to simultaneously excite the radiating plate 206 along the feed line 214 for the rectangular suspended plate antenna 202 to operate with linear polarization The impedance transformer 204 is not electrically connected to the ground plane 208 in any manner.

The radiating plate 206 functions as a planar radiating element and is fed with signals through the impedance transformer 204 along the feed line 214. To provide for circularly polarized operation in the rectangular suspended plate antenna 302 shown in FIG. 3, a radiating plate 306 is fed with signals through an impedance transformer 304, which is a conductive curved metal plate positioned in a generally upright manner to the rectangular suspended plate antenna 302 along a feed line 314 which is correspondingly a substantially curved and continuous line. The impedance transformer 304 is similarly fed by a coaxial probe 312, from an SMA connector 310, extending through a feed-through 311 in a ground plane 308, and is not connected to the ground plane 308 in any manner.

In the foregoing manner, feeding structures for increasing the impedance bandwidth of suspended plate antennas to the order of 60% for a VSWR of 2:1 are disclosed. A number of embodiments are described. However, it will be apparent to one skilled in the art in view of this disclosure that numerous changes and/or modifications can be made without departing from the scope and spirit of the invention.

For example, the radiating plate may be any or combination of rectangular, circular, triangular, bow-tie-like, trapezoidal and the like geometric shape. The radiating plate may also include any or combination of vertical and lateral parasitic elements. The radiating plate may also be flat or uneven. The radiating plate may also be notched or slotted. The radiating plate may also be short-circuited by one or more pins or sheets to the ground plane of the suspended plate antenna.

Additionally, the impedance transformer may be electrically connected to the probe or other signal feeding means for the radiating plate. The impedance transformer may also be notched or slotted. The impedance transformer may also be any or combination of one or more flat sheets, one or more cylinders or part thereof, and one or more symmetric or asymmetric bodies with the contours of arbitrary shapes and profiles. The impedance transformer may also be stacked above the radiating plate opposite the ground plate. The impedance transformer may also be generally oblique with respect to the radiating element. The impedance transformer may also feed the radiating plate through a discretized or continuous line or area.

Further, the ground plane may be any or combination of rectangular, circular, triangular, bow-tie-like, trapezoidal and the like geometric shape. The ground plane may also be flat or uneven. The ground plane may also be infinite or finite. The ground plane may also be notched or slotted.

What is claimed is:

1. A broadband suspended plate antenna, comprising:

means for feeding signals to the antenna;

a ground conductor;

a radiating element which is separated from the ground conductor; and a feeding element which is electrically connected to the radiating element through a plurality of feed points on the radiating element, wherein the feeding element is electrically connected to the means for feeding signals and stacked with the radiating element and ground conductors;

wherein said feeding element is disposed between said radiating element and said means for feeding signals, and said feeding element feeds said radiating element while performing impedance transfer involving both resistance and reactance between said radiating element and said means for feeding signals.

2. The antenna as in claim 1, wherein the feeding element is multi-dimensional.

3. The antenna as in claim 2, wherein the plurality of feed points on the radiating element forms a multi-dimensional profile.

4. The antenna as in claim 3, wherein the feeding element is a plate.

5. The antenna as in claim 4, wherein the plurality of feed points on the radiating element forms a line.

6. The antenna as in claim 5, wherein the feeding element is a substantially planar plate.

7. The antenna as in claim 6, wherein the plurality of feed points on the radiating element forms a substantially straight line.

8. The antenna as in claim 3, wherein each of the radiating element and ground conductor is substantially planar and disposed substantially in parallel with the other.

9. The antenna as in claim 8, wherein the multi-dimensional feeding element is sandwiched between the radiating element and ground conductor.

10. The antenna as in claim 9, wherein the multi-dimensional feeding element is substantially oblique with the planarity of the radiating element.

11. The antenna as in claim 9, wherein the multi-dimensional feeding element is substantially orthogonal with the planarity of the radiating element.

12. The antenna as in claim 1, further including a dielectric material for separating the radiating element and ground conductor.

13. The antenna as in claim 1, wherein the feeding element is stacked between the radiating element and ground conductor.

14. The antenna as in claim 1, wherein the plurality of feed points are located within the perimeter of the radiating element.

15. A method for feeding a broadband suspended plate antenna having a radiating element and ground conductor, comprising the steps of:

feeding signals to the antenna by means for feeding signals;

separating a radiating element from a ground conductor;

providing a feeding element and electrically connecting the feeding element to the radiating element through a plurality of feed points on the radiating element, wherein the feeding element is electrically connected to the means for feeding signals and stacked with the radiating element and ground conductor;

disposing said feeding element between said radiating element and said means for feeding signals; and feeding said radiating element by said feeding element while performing impedance transfer involving both resistance and reactance between said radiating element and said means for feeding signals.

16. The method as in claim 15, wherein the step of providing the feeding element comprises stacking the feeding element between the radiating element and ground conductor.

17. The method as in claim 15, wherein the step of providing the feeding element comprises locating the plurality of feed points within the perimeter of the radiating element.

18. The method as in claim 15, wherein the step of providing the feeding element comprises providing a feeding element which is a plate.

19. The method as in claim 18, wherein the step of providing the feeding element comprises locating the plurality of feed points along a line.

20. The method as in claim 19, wherein the step of providing the feeding element comprises providing a feeding element which is a substantially planar plate and locating the plurality of feed points along a substantially straight line.

* * * * *